US007441812B2

(12) United States Patent
Welsh et al.

(10) Patent No.: US 7,441,812 B2
(45) **Date of Patent: *Oct. 28, 2008**

(54) LINEAR COMPRESSION LATCH

(75) Inventors: Thomas Welsh, Philadelphia, PA (US); Eric D. Hyp, Aspers, PA (US); Richard C. Saile, Phoenixville, PA (US)

(73) Assignee: Southco, Inc., Concordville, PA (US)

( * ) Notice: Subject to any disclaimer, the term of this patent is extended or adjusted under 35 U.S.C. 154(b) by 1307 days.

This patent is subject to a terminal disclaimer.

(21) Appl. No.: 09/935,926

(22) Filed: Aug. 23, 2001

(65) Prior Publication Data

US 2002/0079708 A1 Jun. 27, 2002

Related U.S. Application Data

(60) Provisional application No. 60/228,726, filed on Aug. 27, 2000.

(51) Int. Cl.
*E05C 1/06* (2006.01)
*E05C 5/00* (2006.01)

(52) U.S. Cl. ..... 292/143; 292/7; 292/66; 292/139; 292/DIG. 31

(58) Field of Classification Search ..... 292/66, 292/71, 7, 143, DIG. 31, 70, 139, DIG. 49, 292/DIG. 73, 63, 247
See application file for complete search history.

(56) References Cited

U.S. PATENT DOCUMENTS

| | | | | | |
|---|---|---|---|---|---|
| 66,984 | A | * | 7/1867 | Miller | 292/346 |
| 389,217 | A | * | 9/1888 | Glenn | 292/342 |
| 818,303 | A | * | 4/1906 | Seaman | 292/132 |
| 1,136,498 | A | * | 4/1915 | Tower | 292/36 |
| 1,979,560 | A | * | 11/1934 | Levine | 70/66 |
| 2,348,065 | A | * | 5/1944 | George | 292/1 |
| 2,509,844 | A | * | 5/1950 | Saner | 292/63 |
| 2,934,370 | A | * | 4/1960 | Love et al. | 292/142 |
| 3,341,239 | A | * | 9/1967 | Wheeler | 292/139 |
| 3,586,360 | A | * | 6/1971 | Perrotta | 292/26 |
| 3,706,467 | A | * | 12/1972 | Martin | 292/111 |
| 3,789,550 | A | * | 2/1974 | Seiwert | 49/503 |
| 3,831,580 | A | * | 8/1974 | McLean | 126/197 |
| 3,848,912 | A | * | 11/1974 | Jensen et al. | 292/256.5 |
| 3,970,213 | A | * | 7/1976 | Clay | 220/324 |
| 4,163,443 | A | * | 8/1979 | Peterson | 126/197 |
| 4,412,404 | A | * | 11/1983 | Manning | 52/19 |
| 4,828,299 | A | * | 5/1989 | Poe | 292/139 |
| 4,838,624 | A | * | 6/1989 | Walla | 312/221 |
| 4,858,970 | A | * | 8/1989 | Tedesco et al. | 292/113 |
| 5,012,794 | A | * | 5/1991 | Faurel | 126/197 |
| 5,039,143 | A | * | 8/1991 | Ramsauer | 292/39 |
| 5,080,409 | A | * | 1/1992 | Niswonger | 292/345 |
| 5,120,093 | A | * | 6/1992 | Carney | 292/60 |
| 5,184,489 | A | * | 2/1993 | Squires et al. | 70/58 |

(Continued)

OTHER PUBLICATIONS

Southco Inc., Latches and Access Hardware, Handbook 45 (1995), pp. F-2, E-2 through E-15, front and back covers.

*Primary Examiner*—Carlos Lugo
(74) *Attorney, Agent, or Firm*—Paul & Paul

(57) ABSTRACT

A linear compression latch includes a lever handle linked to a pawl. As the latch is opened, the pawl is initially constrained to move vertically within a carriage. After an intermediate position is achieved, the pawl is constrained to move horizontally within the carriage.

8 Claims, 8 Drawing Sheets

U.S. PATENT DOCUMENTS 5,201,557 A * 4/1993 Schlack ..... 292/161
5,219,195 A * 6/1993 Lawrence ..... 292/336.3
5,301,989 A * 4/1994 Dallmann et al. ..... 292/142
5,683,124 A * 11/1997 Karpisek ..... 292/143
5,688,001 A * 11/1997 Klein et al. ..... 292/67
5,984,382 A * 11/1999 Bourne et al. ..... 292/113
6,059,329 A * 5/2000 Spitzley ..... 292/336.3
6,109,668 A * 8/2000 Demarco ..... 292/161
6,174,007 B1 * 1/2001 Schlack et al. ..... 292/336.3
6,203,075 B1 * 3/2001 Wells, Jr. et al. ..... 292/113
6,343,815 B1 * 2/2002 Poe ..... 292/113
6,362,975 B1 * 3/2002 Liu et al. ..... 361/796
6,527,307 B2 * 3/2003 Welsh et al. ..... 292/70

* cited by examiner

LINEAR COMPRESSION LATCH

CROSS-REFERENCE TO RELATED APPLICATION

This application claims the benefit of U.S. Provisional Patent Application 60/228,726, filed Aug. 27, 2000.

BACKGROUND OF THE INVENTION

1. Field of the Invention

The present invention relates to compression latches for doors or panels.

2. Brief Description of the Prior Art

Compression latches for mounting on doors or panels are known. Compression latches are used in applications in which it is desirable to both latch a door or panel to the frame in which it is mounted and to seal the edge of the panel to the frame when closed. For example, compression latches are desirable when the opening in which the panel is mounted is provided with a gasket that must be compressed to provide a seal.

Examples of compression latches are provided in the *Southco Handbook* 2000 (Southco, Inc., Concordville, Pa.) at pages 23-69.

Fixed compression latches provide a consistent, pre-set compression while adjustable compression latches provide flexibility in setting the amount of compression.

Compression latches often include a pawl designed to engage the frame inside the enclosure to latch the panel shut. Since the compression latch must be operated from outside the enclosure, there must be a mechanism linking the portion of the latch operated by the user with the pawl positioned inside the enclosure. Further, often the latch mechanism, or at least a substantial portion thereof, protrudes through an aperture in the panel. The latch mechanism itself can reduce the volume of the sealed interior that would otherwise be available.

In some applications, such as cabinets for radio transmitters and telephone equipment for outdoor use, the enclosure preferably remains well sealed against the environment, to avoid environmental stresses penetrating into the enclosure and to avoid EMI leakage from equipment to the environment. Thus, in such applications, the latch mounting aperture and the latch itself may present routes between the interior of the enclosure and the exterior, undesirably reducing the degree of isolation of the enclosure from the environment.

There is a continuing need for a simple, easy to install compression latch that provides suitable compression force and yet reduces the extent to which the environmental isolation of the enclosure is compromised by installation and use of the latch.

There is also a continuing need for a compression latch that provides a minimal "footprint" inside the cabinet on which the compression latch is installed.

SUMMARY OF THE INVENTION

The present invention provides a simple linear compression latch that can be easily and securely mounted to a door or panel. The linear compression latch of the present invention provides a consistent, pre-set compression. At the same time, only a small portion of the latch mechanism protrudes into the interior of the enclosure, so that the cabinet is easy to seal against the environment. The linear compression latch of the present invention is simple to manufacture, assemble and install, and is preferably assembled from less than a dozen parts.

The linear compression latch of the present invention takes up a minimum of useable space within the enclosure, thus minimizing or eliminating the space previously used by other types of compression latches inside the sealed area of a cabinet. The linear compression latch of the present invention provides a single-point compression between a door and a frame.

The compression is provided by a pawl, which moves toward the door as the handle of the latch is closed. The pawl moves in a motion which combines substantially in a plane parallel to the surface of the door and a motion toward or away from the door. To open the linear compression latch, a lever is pulled upward, away from the latch. This causes the pawl to initially move away from the door frame, and then to withdraw from under the door frame to a position under the door so that the door can be opened. Overall, the pawl moves in an "L"-shaped motion.

The linear compression latch includes a housing and a lever mounted in the housing and rotatable by an operator between a first position and a second position. The latch also includes a pawl mounted for substantially linear motion. The pawl is actuated by rotation of the lever, travels substantially linearly between an open position to a closed position as the lever is rotated between the first position and the second position. Preferably, the pawl is mounted to travel between the open position and an intermediate position along a first path, and then to travel in a second path in a direction substantially perpendicular to the first path between the intermediate position and the closed position. For example, when the latch is being opened, the pawl initially travels downward along a substantially linear path from a first position to an intermediate position, then it travels in a second linear path away from the door frame from the intermediate position to the second position in which the entire pawl is positioned under the door, the latch is fully open, and the door can be opened.

In the closed position the pawl presses upward against the underside of the door frame to compress a gasket between the door and the door frame. When the latch is opened, the pawl initially travels downward away from the door frame to release the compression on the gasket. Preferably, the latch also includes a link means for linking the lever and the pawl.

It is thus an object of the present invention to provide a compression latch having a substantially linear motion.

It is a further object of the present invention to provide a compression latch that can be easily and effectively sealed.

These and other objects of the invention will become apparent through the following description and claims.

DETAILED DESCRIPTION OF THE PREFERRED EMBODIMENT

The present invention provides a simple linear compression latch that can be easily and securely mounted on the outside of a door or panel. The linear compression latch of the present invention provides a consistent, pre-set compression.

The linear compression latch of the present invention is simple to manufacture, assemble and install, and is preferably assembled from less than a dozen parts.

Figure 1:
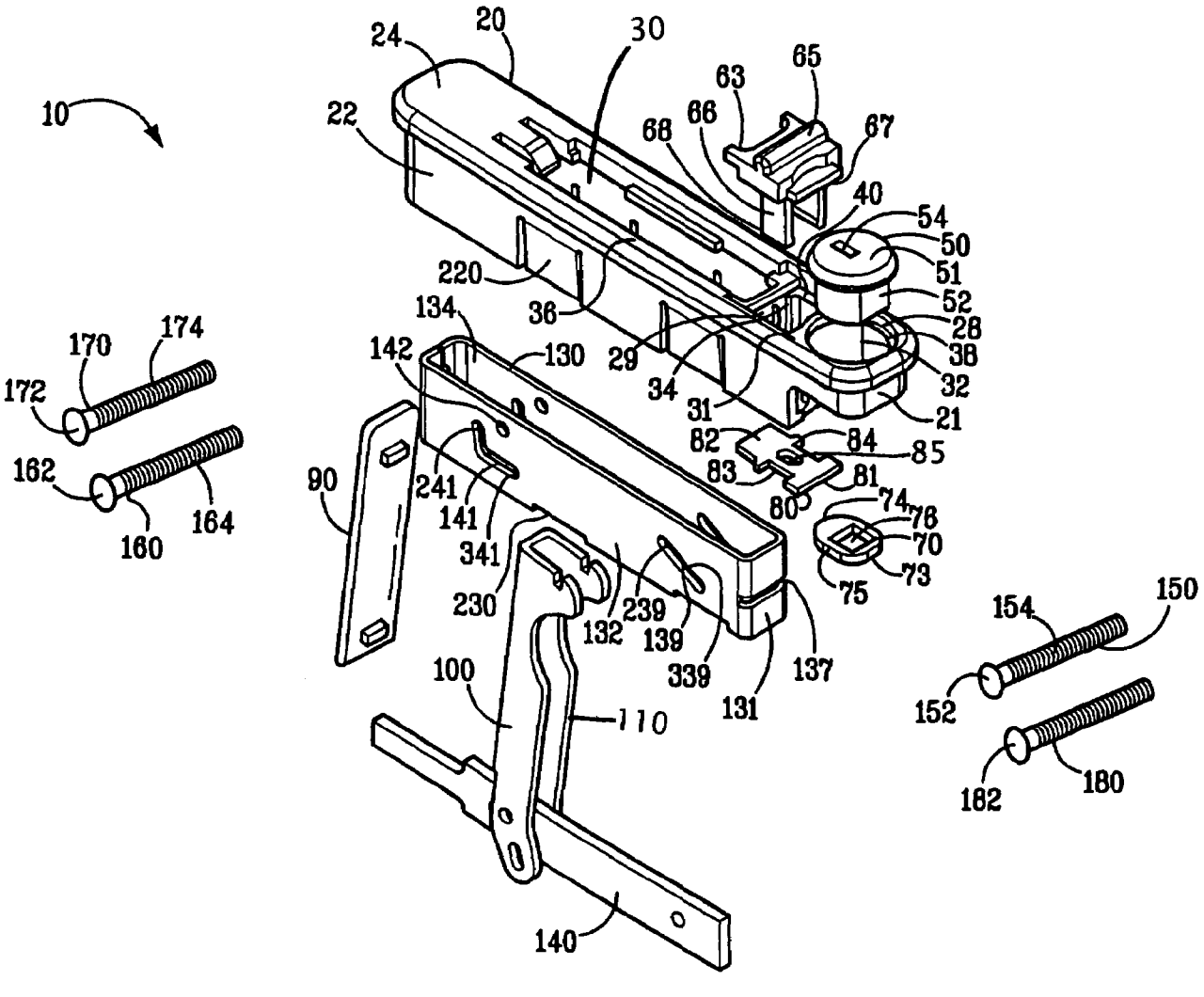
FIG. 1 is an exploded perspective view of a linear compression latch according to the present invention.
Figure 2:
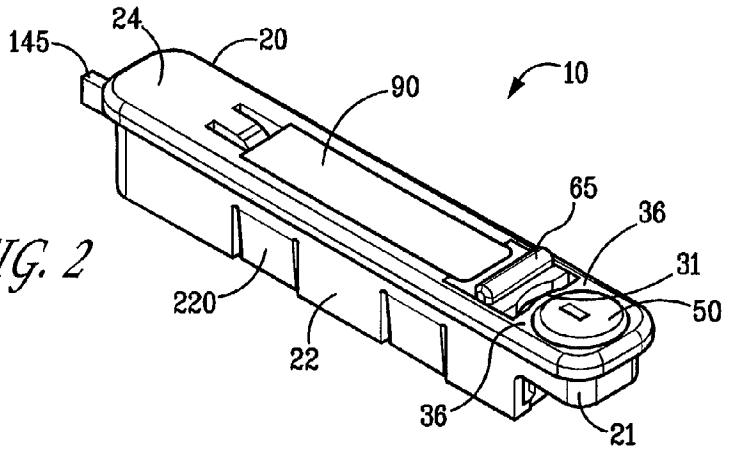
FIG. 2 is a perspective view of the latch of FIG. 1 shown in a closed and latched position.
Figure 4:
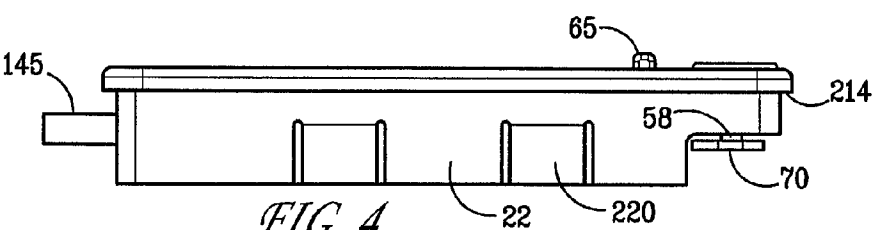
FIG. 4 is a side elevational view of the latch of FIG. 1 shown in a closed and latched position.
Figure 6:
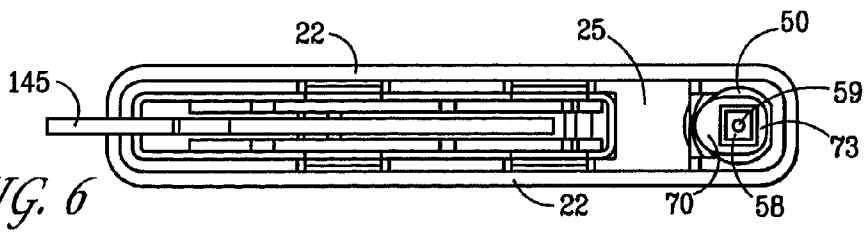
FIG. 6 is a bottom plan view of the latch of FIG. 1 shown in a closed and latched position.
Figure 3:
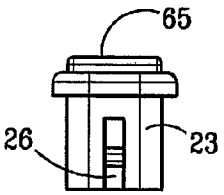
FIG. 3 is a rear view of the latch of FIG. 1 shown in a closed and latched position.
Figure 5:
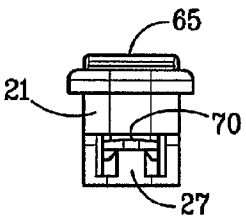
FIG. 5 is a front view of the latch of FIG. 1 shown in a closed and latched position.
Figure 8:
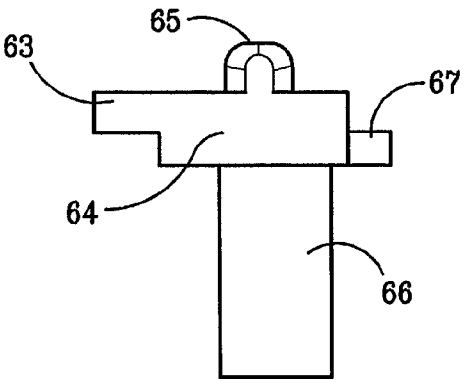
FIG. 8 is a side view of the button of FIG. 7.
Figure 9:
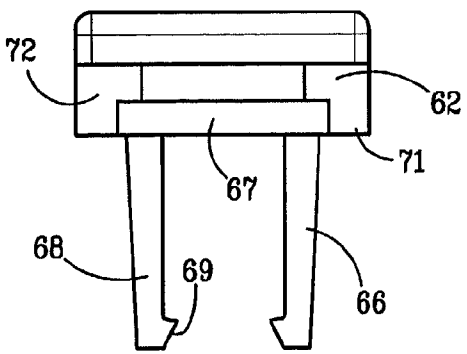
FIG. 9 is a front view of the button of FIG. 7.
Figure 7:
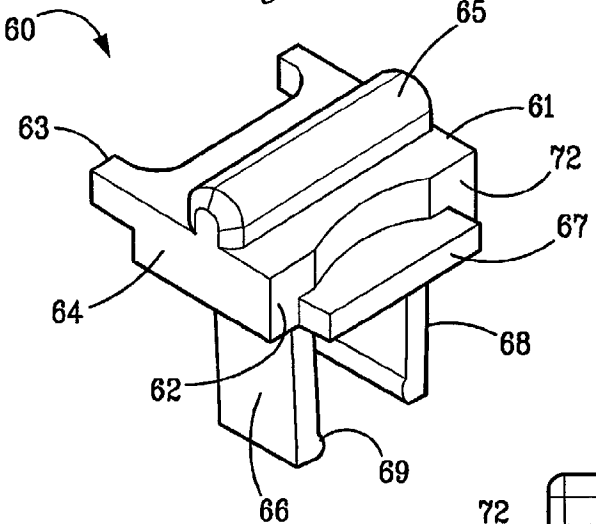
FIG. 7 is a perspective view of the button of the latch of FIG. 1.

Referring now to the figures in which like reference numerals refer to like elements in each of the several views, there is shown in FIG. 1 a linear compression latch 10 according to the present invention in an exploded perspective view.

The linear compression latch 10 includes an elongated housing 20, a conventional lockplug 50, a button 60, a lockpawl 70, a lockplate 80, a cover 90, an elongated lever handle 100, an elongated cartridge 130, an elongated pawl 140, a first pin 150, a second pin 160, and a pivot attachment pin 170.

Figure 24:
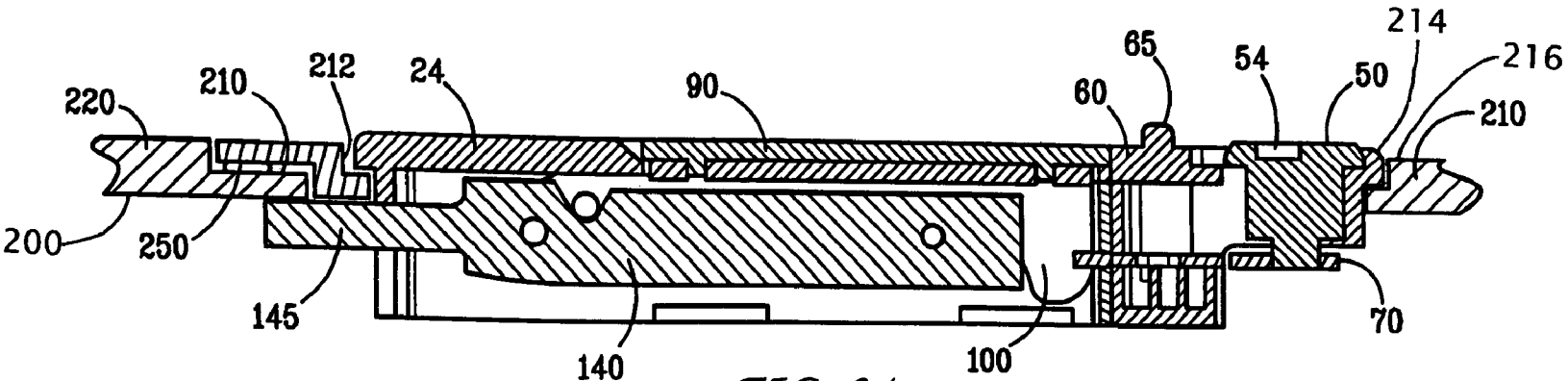
FIG. 24 is a side elevational section view of the latch of FIG. 3 showing the latch in a closed and latched position and mounted on a door that the latch secures to a door frame.

The housing 20 is for mounting on the outside of a door or panel 210 of a cabinet or enclosure (not shown) having a frame 221 (FIG. 24). As illustrated in FIGS. 1-6, the housing 20 includes a front wall 21, a pair of opposing side walls 22, a rear wall 23, a substantially open top wall 24, a substantially open bottom 25, and a central elongated cavity or well 30 in which much of the latch mechanism is housed as described below. The underside of the top wall 24 forms a shoulder or flange 214 which extends about the periphery of the housing 20. Each side wall 22 has a pair of snap legs 220 formed therein. The rear wall 23 has a central vertical slot 26 for receiving the pawl 140. As can be seen in Fig., the front wall 21 and side walls 22 are cut away at one end of the housing 20, and they collectively define a cutout 27 in which the lockplug 50 and lockpawl 70 can be easily accessed. The housing 20 also includes a first opening 28 formed in the housing 20 proximate the front end of the housing 20, a first countersink 38 located inwardly about the first opening 28, a second opening 29 formed in the housing 20 rearward of the first opening 28, a second countersink 40 located inwardly about the second opening 29, a separation extension 31, a first chamber 32 formed therein, and a second chamber 34 formed therein. The separation extension 31 extends between the sides 36 of the top wall 24 and separates the first and second openings 28, 29. The first chamber 32 (as illustrated in FIG. 1) is adapted to receive the lockplug 50. The first countersink 38 is adapted to removably retain the lockplug 50. The second chamber 34 (as illustrated in FIG. 1) is adapted to receive the button 60. The second countersink 40 is adapted to removably retain the button 60.

As illustrated in FIG. 24, the latch 10 is installed in an aperture 212 formed in the door 210 proximate the edge thereof. The installation aperture 212 is sized to receive the housing 20, except for the top wall 24 of the housing 20. When the latch 10 is mounted on the door 210, the housing 20, except for the top wall 24 of the housing 20, extends through the installation aperture 212 into the interior of the enclosure 200, while the top wall 24 of the housing 20 remains on the outside of the door 210. The shoulder 214 of the top wall 24 abuts the outer surface of the door 210 when the latch 10 is installed in the door 210. The door 210 may alternatively have a countersink 216 about the aperture 212 where the shoulder 214 abuts the surface of the countersink 216 so that the latch 10 is positioned flush against the door 210.

Figure 11:
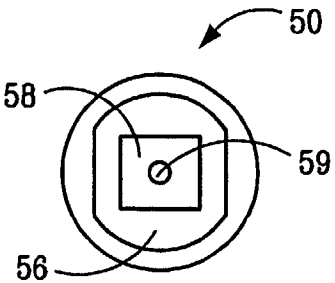
FIG. 11 is a bottom plan view of the lockplug of FIG. 10.
Figure 10:
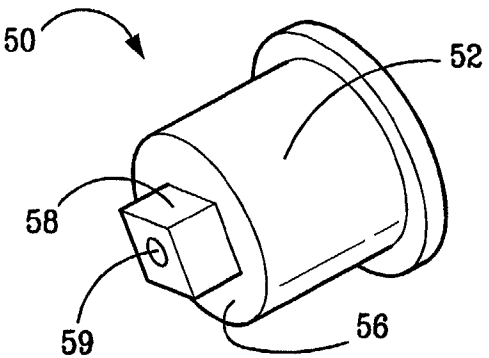
FIG. 10 is a bottom perspective view of the lockplug of the latch of FIG. 1.

As illustrated in FIGS. 1 and 10-11, the lockplug 50 includes a generally circular top end 51 having a key slot 54, a cylindrical body 52 that can be rotated from a locked position to an open position by insertion of a key (not shown) in the key slot 54, and a bottom end 56. The bottom end 56 has a square extension 58 with an aperture 59 to engage with the lockpawl 70 so that the latch 10 can be placed in the open position from the closed position, and vice versa. This engagement may be accomplished by friction fitting the square extension 58 with the lockpawl 70, fitting the square extension 58 with the lockpawl 70 and having an engagement pin 180 engage the square extension 58 with the lockpawl 70, or any other known method in the art. If the bottom end 56 of the lockplug 50 does not include the square extension 58, the lockpawl 70 can still engage with the lockplug 50. The engagement of this alternative embodiment may be accomplished by securing the lockpawl 70 to the bottom end 56 of the lockplug 50 by adhesive or other substances, or any other known method in the art. The lockplug 50 is accessible through the first opening 28 of the housing 20.

As illustrated in FIGS. 1 and 7-9, the button 60 includes an upper portion 61 having a front end 62, a generally curved rear end 63, a pair of sides 64, a curved grip extension 65 extending generally perpendicularly upward from the plane defined by the upper portion 61, a pair of opposing legs 66 extending downwardly from the sides 64, and a tongue 67 extending forwardly of the front end 62. The lower end 68 of each leg 66 has a flange 69 extending inwardly such that the flanges 69 are in opposing relationship to one another. The tongue 67 is generally centrally located at the lower portion 71 of the front end 62 such that a substantial portion of the upper portion 72 of the front end 62 is exposed for making contact with the separation extension 31 of the housing 20.

As illustrated in FIG. 1, the lockpawl 70 has a generally oval shape, a curved front end 73, a curved rear end 74, a pair of sides 75, and a generally square central aperture 76. The distance between the front and rear ends 73, 74 of the lockpawl 70 is greater than the distance between the sides 75 of the lockpawl 70. The lockpawl 70 is mounted on the bottom end 56 of the lockplug 50 by fitting the central aperture 76 of the lockpawl 70 over the bottom extension 58 of the lockplug 50 and securing the lockpawl 70 to the bottom extension 58 by the engagement pin 180 so that when the cylindrical body 52 of the lockplug 50 is rotated within the first chamber 32 of the housing 20, the lockpawl 70 also rotates. The head 182 of the engagement pin 180 has a larger diameter than the diameter of the central aperture 76.

As illustrated in FIG. 1, the lockplate 80 has a generally rectangular shape, a front end 81, a rear end 82, a pair of sides 83, a pair of fingers 84 extending generally perpendicularly outwardly from the plane defined by the sides 83, and a generally central aperture 85. The front end 81 also extends generally perpendicularly outwardly from the plane defined by the sides 83 such that the side edges of the front end 81 and fingers 84 are preferably in general alignment to one another. The distance between the front and rear ends 81, 82 of the lockplate 80 is greater than the distance between the sides 83 of the lockplate 80.

Figure 13:
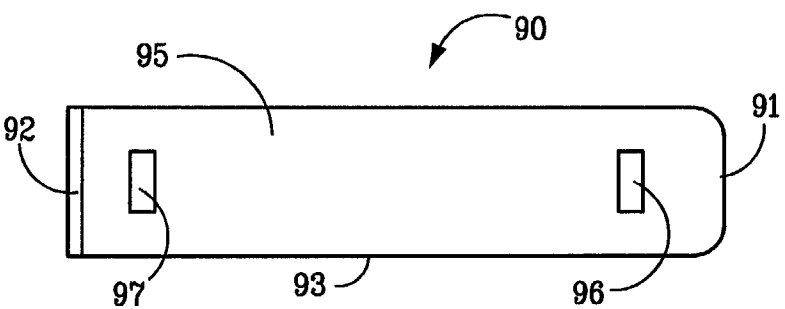
FIG. 13 is a bottom view of the cover of FIG. 12.
Figure 12:
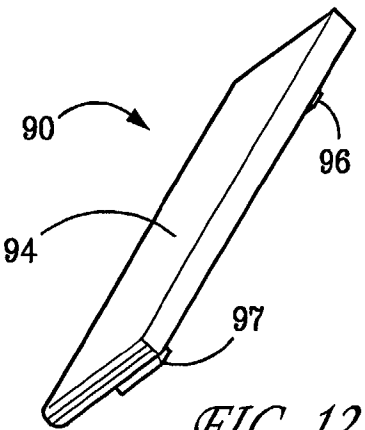
FIG. 12 is a top perspective view of the cover of the latch of FIG. 1.
Figure 14:
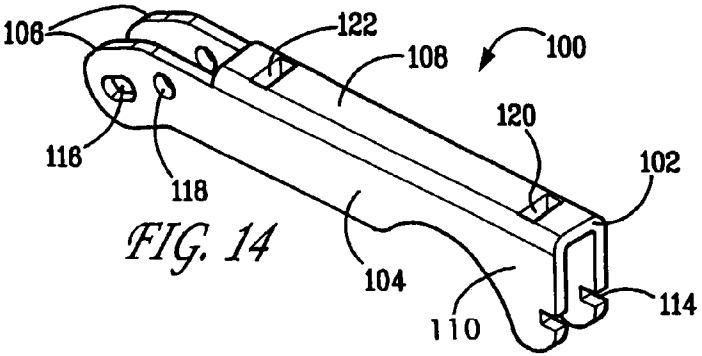
FIG. 14 is a perspective view of the lever handle of the latch of FIG. 1.
Figure 16:
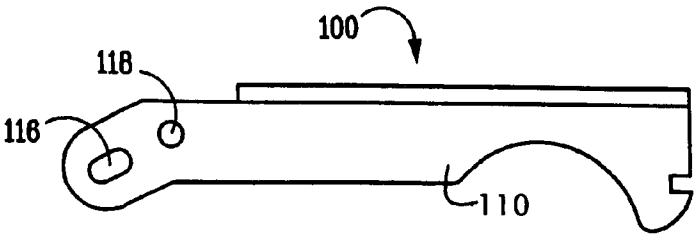
FIG. 16 is a side view of the handle of FIG. 14.
Figure 18:
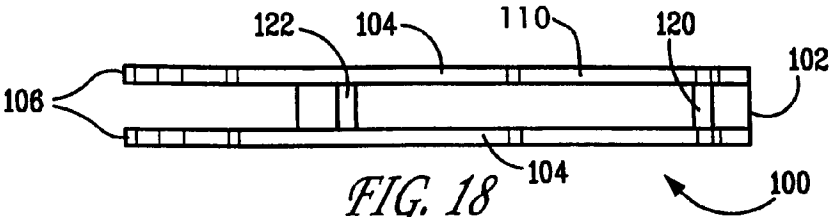
FIG. 18 is a bottom plan view of the handle of FIG. 14.
Figure 15:
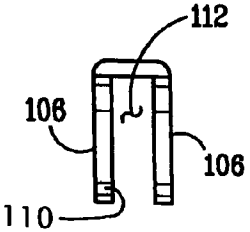
FIG. 15 is a rear view of the handle of FIG. 14.
Figure 17:
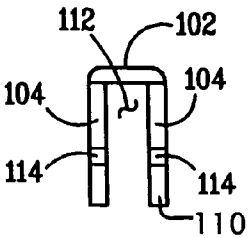
FIG. 17 is a front view of the handle of FIG. 14.

As illustrated in FIGS. 1 and 12-13, the generally planar cover 90 has a front end 91, a rear end 92, a pair of opposing sides 93, a top surface 94, and a bottom surface 95. The bottom surface 95 has a first locking extension 96 located about the front portion of the bottom surface 95, and a second locking extension 97 located about the rear portion of the bottom surface 95 for engaging with the lever handle 100 to enclose the central cavity 30 of the housing 20 and conceal the latch mechanism.

As illustrated in FIGS. 1 and 14-18, the elongated lever handle 100 has a substantially open front end 102, a pair of opposite side walls 104, a substantially open rear end 106, a top wall 108, a substantially open bottom end 110, and an elongated channel 112 defined therein for receiving the pawl 140 when the latch 10 is placed in the closed position. Each side wall 104, at the front, lower portion, has a slot 114 adapted to receive and removably retain a portion of the rear end 82 of the lockplate 80 so that the handle 100 can be removably secured to the lockplate 80 when the latch 10 is placed in the closed position. Each side wall 104 also has a first aperture 116 and a pivot attachment aperture 118 located about the rear portion of the side wall 104. The first apertures 116 are in opposing relationship to one another and are adapted to receive the second pin 160. The pivot attachment apertures 118 are in opposing relationship to one another and are adapted to receive the pivot attachment pin 170. The bottom, front portion of each side wall 104 of the handle 100 may be curved upwardly toward the top wall 108 of the handle 100 so as to provide comfort and better gripping leverage for the operator operating the handle 100. The top wall 108 has a first locking aperture 120 about the front portion of the top wall 108 and a second locking aperture 122 about the rear portion of the top wall 108. The first locking aperture 120 is adapted to engage with the first locking extension 96 of the bottom surface 95 of the cover 90. The second locking aperture 122 is adapted to engage with the second locking extension 97 of the bottom surface 95 of the cover 90.

Figure 20:
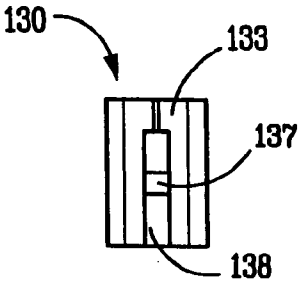
FIG. 20 is a rear view of the carriage of FIG. 19.
Figure 19:
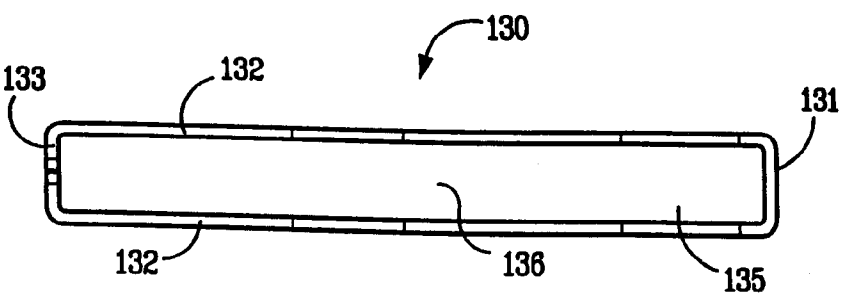
FIG. 19 is a bottom plan view of the carriage of the latch of FIG. 1.

As illustrated in FIGS. 1 and 19-20, the carriage 130 has a front wall 131, a pair of opposite side walls 132, a rear wall 133, a substantially open top end 134, a substantially open bottom end 135, and an elongated channel 136 defined therein for receiving the handle 100 and pawl 140. The front wall 131 has a generally centrally located horizontal slot 137 formed therein for receiving and removably retaining a portion of the rear end 82 of the lockplate 80 when the latch 10 is placed in the locked position. Each side wall 132 of the carriage 130 has a pair of cutouts 230 located about the bottom portion of the side wall 132. The rear wall 133 has a generally centrally located vertical slot 138 formed therein for receiving and retaining a portion of the pawl 140 when the latch 10 is placed in the locked or unlocked position. Each front portion of the side wall 132 has an upwardly and rearwardly extending slot 139 formed therein for receiving and retaining the first pin 150 when the latch 10 is placed in the locked or unlocked position. Each rear portion of the side wall 132 has an "L"-shaped slot 141 formed therein for receiving and retaining the second pin 160 when the latch 10 is placed in the locked or unlocked position. Each rear portion of the side wall 132 also has a pivot attachment aperture 142 formed therein for receiving and retaining the third pin 170 when the latch 10 is placed in the locked or unlocked position. The slots 138, 139, 141 and first and second pins 150, 160 permit the pawl 140 to move upward and rearward relative to the slots 138, 139, 141 when the latch 10 is placed in the closed position from the open position, and to move downward and forward relative to the slots 138,139, 141 when the latch 10 is placed in the open position from the closed position. The upwardly and rearwardly extending slots 139 and "L"-shaped slots 141 serve to guide the motion of the first and second pins 150, 160 and pawl 140. The pivot attachment aperture 142 and third pin 170 permit the handle 100 to pivot upward and downward relative to the housing 20 when the latch 10 is placed in the open position from the closed position, and in the closed position from the open position.

Figure 22:
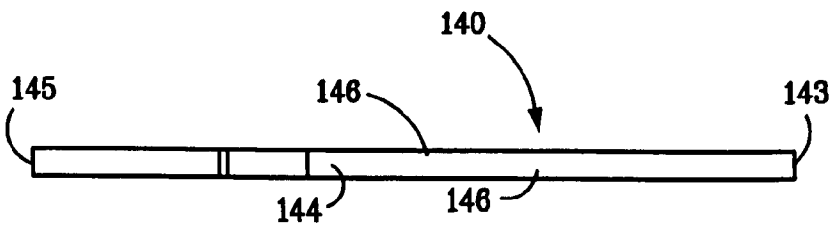
FIG. 22 is a bottom plan view of the pawl of FIG. 21.
Figure 21:
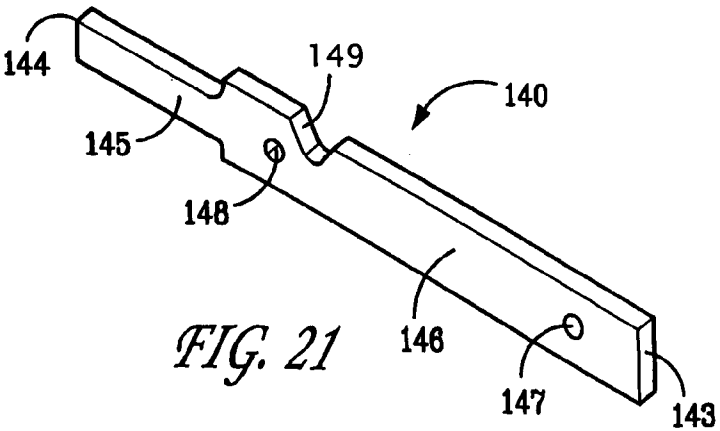
FIG. 21 is a perspective view of the pawl of the latch of FIG. 1.
Figure 23:
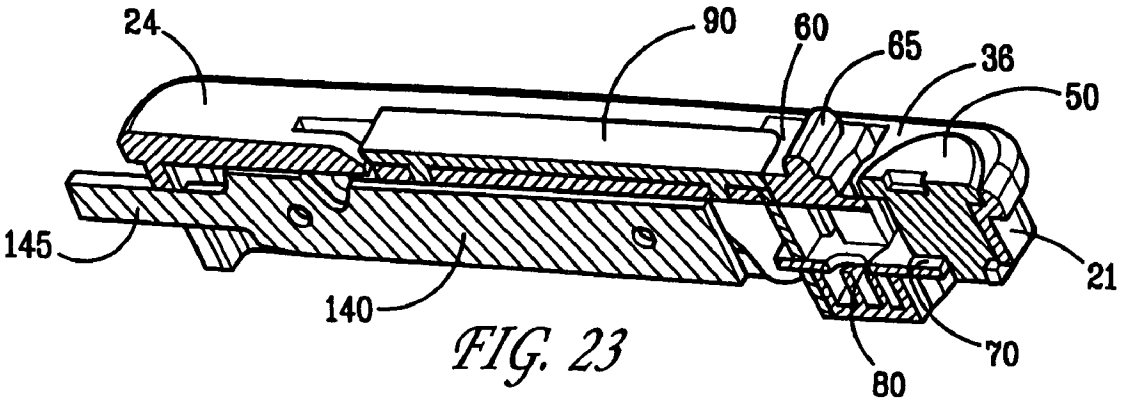
FIG. 23 is a perspective sectional view of the latch of FIG. 2 showing the latch in a closed and latched position.

As illustrated in FIGS. 1 and 21-22, the pawl 140 has a front end 143, a rear end 144, a rear end extension 145, a pair of sides 146, a first aperture 147 extending through the front portion of the sides 146, a second aperture 148 extending through the rear portion of the sides 146, and a clearance cut 149 located generally about the top rear portion of the sides 146. The clearance cut 149 permits the pivot attachment pin 170 to not interfere with the movement of the pawl 140 when the handle 100 is rotated upward or downward relative to the housing 20.

As illustrated in FIG. 1, each of the first, second, and pivot attachment pins 150, 160, 170 has a head 152, 162, 172, and a shaft 154, 164, 174, respectively. Each shaft 154, 164, 174 is sized to pass through and be removably retained within its corresponding slots and/or apertures. Each head 152, 162, 172 is sized for not passing through its corresponding slots and/or apertures. Each pin 150, 160, 170 can be removably retained within its corresponding slots and/or apertures by a nut, deformation of the end of the pin 150, 160, 170, friction fitting of the shaft 154, 164, 174 within its corresponding slots and/or apertures, and any known method in the art.

When the latch 10 is assembled, the first pin 150 is positioned to pass through (1) the first aperture 147 of the pawl 140, and (2) the upwardly and rearwardly extending slots 139 of the front portions of the side walls 132 of the carriage 130. Also, the second pin 160 is positioned to pass through (1) the first apertures 116 of the handle 100, (2) the second aperture 148 of the pawl 140, and (3) the "L"-shaped slots 141 of the side walls 132 of the carriage 130. The first and second pins 150, 160 are preferably securely mounted within the first aperture 147 of the pawl 140 and the second aperture 148 of the pawl 140, respectively, so that the pins 150, 160 and pawl 140 move as a unit.

When the latch 10 is assembled, the pivot attachment pin 170 is positioned to pass through (1) the pivot attachment apertures 118 of the handle 100, and (2) the pivot attachment apertures 142 of the side walls 132 of the carriage 130.

When the latch 10 is assembled, the lockplug 50 is removably positioned within the first chamber 32 of the housing 20 and removably retained by the first countersink 38 of the housing 20. The lockpawl 70 is removably secured to the bottom end 56 of the lockplug 50 such that the front end 73 of the lockpawl 70 is most forward relative to the front end of the housing 20. The lockplate 80 is removably positioned within the second chamber 34 of the housing 20 such that the front end 81 of the lockplate 80 is most forward relative to the front end of the housing 20. The button 60 is removably secured to the lockplate 80, with the legs 66 of the button 60 securing themselves between the fingers 84 of the sides 83 and the front end 81 of the lockplate 80 where the flanges 69 are positioned beneath the underside of the lockplate 80, as the button 60 is removably positioned within the second chamber 34 of the housing 20 such that the front end 62 of the button 60 is most forward relative to the front end of the housing 20. The handle 100, pawl 140, and carriage 130 are removably secured to one another by the pins 150, 160, 170 such that the rear end extension 145 of the pawl 140 extends through the vertical slot 138 of the rear wall 133 of the carriage 130, and, when the handle 100 is in the closed position relative to the pawl 140 and carriage 130, the pivot attachment pin 170 is positioned within the clearance cut of the pawl 140. The carriage assembly is removably positioned within the central cavity 30 of the housing 20 such that the front wall 131 of the carriage 130 is most forward relative to the front end of the housing 20. The carriage assembly is snapped into place within the housing 20 by the snap legs 220 of the side walls 22 of the housing 20 catching the cutout 230 of the underside of the carriage 130. The carriage assembly is thus held in place in the housing 20. The cover 90 may be attached to the handle 100 to enclose the central cavity 30 of the housing 20 and conceal the latch mechanism. When the cover 90 encloses the central cavity 30, the cover 90 is generally flush with the top wall 24 of the housing 20.

When the latch 10 and lockplug 50 are in the closed or locked position (as illustrated in FIGS. 2-6 and 23-24), the front end 81 of the lockplate 80 is proximate to the rear end 74 of the lockpawl 70 such that the lockplate 80 cannot slide forward toward the front end of the housing 20. This prevents the handle 100 that is removably secured to the rear end 82 of the lockplate 80 from being able to be rotated upward away from the front end of the housing 20 and toward the rear end of the housing 20 by the operator (not shown). The pawl 140 is positioned most upward and rearward relative to the front end of the housing 20 and front wall 131 of the carriage 130. The first and second pins 150, 160 are positioned most upward and rearward relative to the front end of the housing 20 and slots 139, 141, respectively.

Figure 26:
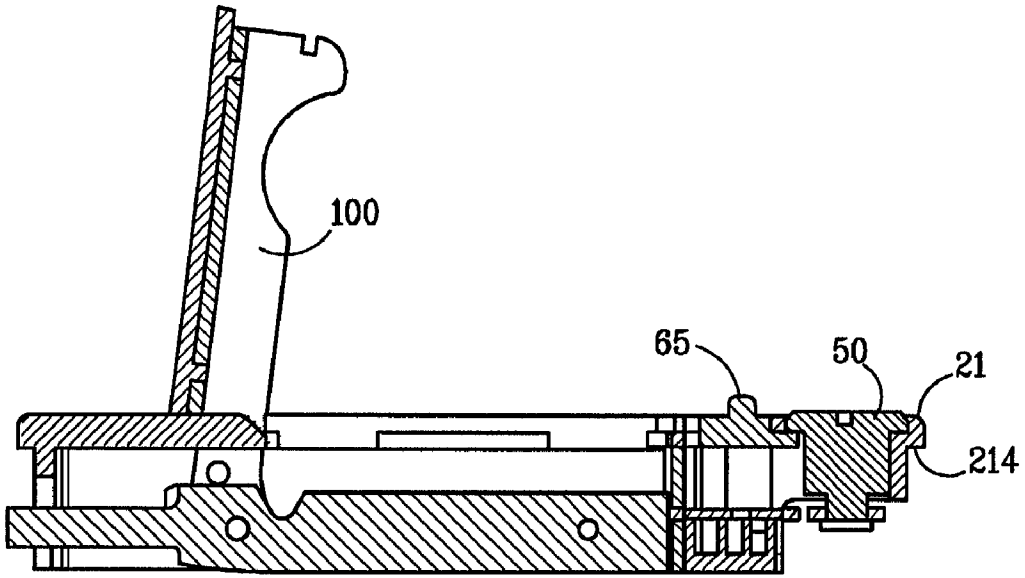
FIG. 26 is a side elevational section view of the latch of FIG. 24 showing the latch in an open position.
Figure 25:
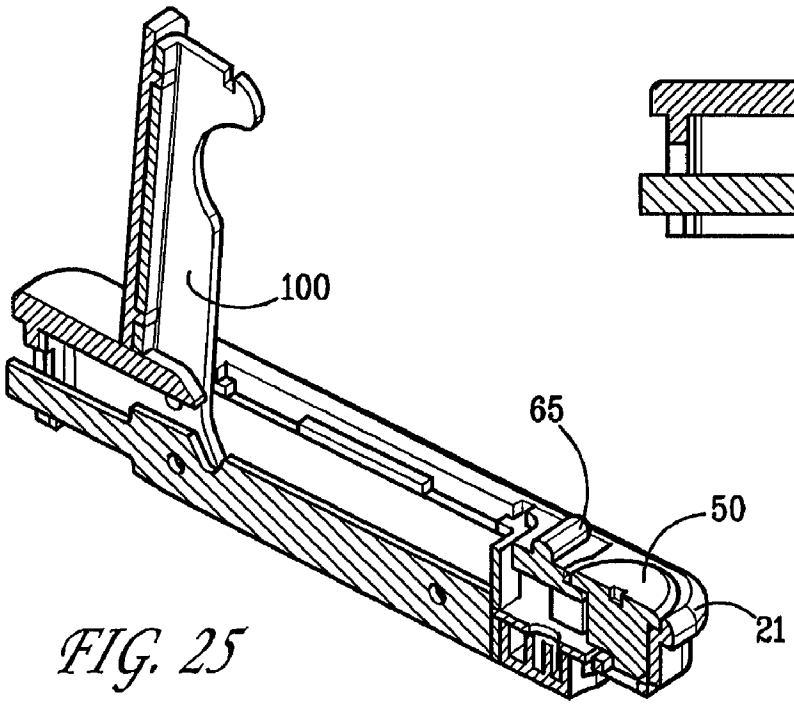
FIG. 25 is a perspective sectional view of the latch of FIG. 23 showing the latch in an open position.

After the lockplug 50 has been rotated by the operator from a locked to an unlocked position to unlock the latch 10 (as illustrated in FIGS. 25-26), the lockpawl 70 no longer prevents the lockplate 80 from sliding forward toward the front end of the housing 20. When the operator radially displaces the lockplug 50 and lockpawl 70, the lockplate 80 can be slid forward toward the front end of the housing 20 by the operator grasping the grip extension 65 of the button 60 and sliding the button 60 forward toward the front end of the housing 20 until the upper portion 72 of the front end 62 of the button 60 makes contact with the separation extension 31 of the housing 20. The sliding of the lockplate 80 forward toward the front end of the housing 20 and away from the slots 114 of the handle 100 permits the handle 100 to be released so that the operator can open the latch 10. After the handle 100 is released from its closed position, the operator can pull and rotate the handle 100 upward and away from the front end of the housing 20. As the handle 100 rotates upward, the first pin 150, being constrained to travel within the upwardly and rearwardly extending slots 139 of the front portions of the side walls 132 of the carriage 130, and the second pin 160, being constrained to travel within "L"-shaped slots 141 of the side walls 132 of the carriage 130, both simultaneously initially travel downward from a first or closed position in the upper portions 239 of the extending slots 139 and the short portions 241 of the "L"-shaped slots 141, respectively, carrying the pawl 140 downward to an intermediate position, where the upper portions 239 and the lower portions 339 of the extending slots 139 meet, and the short portions 241 and the long portions 341 of the "L"-shaped slots 141 meet, respectively.

This downward motion "decompresses" the latch 10, and releases the gasket 250 as the pawl 140 is carried downward away from contact with the bottom of the edge of the door frame 220. When the first and second pin 150, 160 simultaneously reach the end of their travel within the upper portions 239 of the extending slots 139 and short portions 241 of the "L"-shaped slots 141, respectively, the continued downward rotational motion of the handle 100 forces both the first and second pins 150, 160 to move forward simultaneously in both the lower portions 339 of the extending slots 139 and the horizontally extending long portions 341 of the "L"-shaped slots 141, respectively, moving the pawl 140 forward horizontally, away from the door frame 220, so that the door 210 can be opened. The first and second pins 150, 160 and pawl 140 thus move "forward" along the lower portions 339 of the extending slots 139 and the horizontally extending long portions 341 of the "L"-shaped slots 141, respectively, from an intermediate position to a second or open position.

When the latch 10 is closed by rotating the handle 100 downward, the first and second pins 150, 160 and pawl 140 retrace their motion from their second position to their intermediate position, the pawl 140 being moved "inward" towards the underside of the door frame 220. Continued motion of the handle 100 downward forces the first and second pins 150, 160 to simultaneously travel upward from their intermediate position to their first or closed position, lifting the pawl 140 into contact with the underside of the door frame 220 and compressing the gasket 250.

The latch 10 can be held in place within the mounting aperture of the door 210 using any known means, including but not limited to screws, rivets, etc. which engage the shoulder 214 and clamp the housing 20 to the door 210. Additionally, a frame (not shown) which surrounds the side walls 22 of the housing 20 and abuts the interior surface of the door 210 can be used to hold the housing 20 in place. Such a frame would be fixed to the side walls 22 of the housing 20 by any well known means, such as screws, fusion welds, pins, rivets, adhesives, etc., and such a frame would, in cooperation with the shoulder 214, clamp the housing 20 in place within the mounting aperture.

It is preferred that the latch 10 be constructed of a suitable, sufficiently strong and rigid plastic material, a metal, a combination of metal and plastic materials, or other suitable materials.

It is to be understood that the invention is not limited to the preferred embodiment described herein, but encompasses all embodiments within the scope of the following claims.

We claim:

1. A linear compression latch comprising;

a housing;

a lever handle rotatable by an operator between a first position and a second position, the lever handle being mounted in the housing;

a pawl mounted for substantially linear motion, the pawl being actuated by rotation of the lever handle and traveling substantially linearly between an open position to a closed position as the lever handle is rotated between the first position to second position;

wherein the pawl is mounted to travel between the open position along a first path and an intermediate position; and wherein the pawl is mounted to travel in a second path in an upward direction substantially perpendicular to the first path between the intermediate position and the closed position.

2. A linear compression latch according to claim 1 wherein the first path is linear.

3. A linear compression latch according to claim 1 wherein the second path is linear.

4. A linear compression latch according to claim 3 further comprising a carriage, the carriage being mounted for linear motion within the housing, the pawl being mounted within the carriage.

5. A linear compression latch according to claim 4 further comprising connection means for rotatably connecting the lever handle and the pawl.

6. A linear compression latch comprising:

a housing;

a lever handle rotatable by an operator between a first position and a second position, the lever handle being mounted in the housing;

a pawl mounted for substantially linear motion, the pawl being actuated by rotation of the lever handle and traveling substantially linearly between an open position to a closed position as the lever handle is rotated between the first position to second position;

wherein the pawl is mounted to travel between the open position along a first path and an intermediate position;

wherein the pawl is mounted to travel in a linear second path in an upward direction substantially perpendicular to the first path between the intermediate position and the closed position; and a carriage, the carriage being mounted for linear motion within the housing, the pawl being mounted within the carriage.

7. A linear compression latch according to claim 6 further comprising connection means for rotatably connecting the lever handle and the pawl.

8. A linear compression latch according to claim 6 wherein the first path is linear.

* * * * *